US005494236A

United States Patent [19]

Ekholm

[11] Patent Number: 5,494,236

[45] Date of Patent: Feb. 27, 1996

[54] OPEN CASSETTE FOR WINDING A TAPE THEREIN

[75] Inventor: Lars Ekholm, Lovisa, Finland

[73] Assignee: Kb Pat. Plasting Ky, Haddom Lovisa, Finland

[21] Appl. No.: 600,146

[22] Filed: Oct. 17, 1990

Related U.S. Application Data

[63] Continuation of Ser. No. 302,604, Jan. 27, 1989, abandoned.

[30] Foreign Application Priority Data

| | | | |
|---|---|---|---|
| Feb. 1, 1988 | [FI] | Finland | 880449 |
| Jan. 29, 1989 | [FI] | Finland | 890332 |

[51] Int. Cl.[6] ..... B65H 75/18

[52] U.S. Cl. ..... 242/539; 242/597.3

[58] Field of Search ..... 242/55.17, 55.2, 242/55.53, 66, 67.1 R, 68.3, 105, 115, 116, 96, 128, 129, 179, 197, 199, 200, 206, 208, DIG. 3, 532, 532.6, 539, 588.6, 597.3; 206/395, 396, 408, 409

[56] References Cited

U.S. PATENT DOCUMENTS

| | | | |
|---|---|---|---|
| 912,796 | 2/1909 | Boye | 242/67 |
| 943,202 | 12/1909 | Struss | 206/389 |
| 1,729,955 | 10/1929 | Matthaei | 242/68.7 |
| 1,816,385 | 7/1931 | Matthaei | 242/105 |
| 1,871,388 | 8/1932 | Pflueger | 206/395 X |
| 1,882,219 | 10/1932 | Harwood et al. | 242/66 |
| 1,889,933 | 12/1932 | Pratt | 206/396 |
| 1,927,667 | 9/1933 | Miller | 242/55.53 |
| 2,464,676 | 3/1949 | Dotsch | 242/68.7 |
| 2,646,233 | 7/1953 | Gazet | 242/129 |
| 2,824,641 | 2/1958 | Koenig | 206/396 |
| 3,000,494 | 9/1961 | Monroe | 242/55.53 |
| 3,272,328 | 9/1966 | Kutlow | 242/55.53 |
| 3,448,852 | 6/1969 | Dunning | 242/55.53 |
| 3,533,486 | 2/1971 | Meeussen | 242/67.1 R |
| 3,613,973 | 10/1971 | Jaeschke | 206/409 X |
| 3,627,118 | 12/1971 | Daggs | 242/55.53 |
| 3,656,700 | 4/1972 | Gauvin | 242/67.1 R |
| 3,758,043 | 9/1973 | Setzer et al. | 242/68.7 X |
| 4,102,512 | 7/1978 | Lewallyn | 242/DIG. 3 X |
| 4,396,165 | 8/1983 | Bates et al. | 242/67.1 X |
| 4,445,651 | 5/1984 | Kimizuka et al. | 242/199 |
| 4,971,921 | 9/1984 | Corbin | 242/105 X |

FOREIGN PATENT DOCUMENTS

| | | | |
|---|---|---|---|
| 0217736 | 9/1961 | Austria | 242/68 |
| 217376 | 9/1961 | Austria | 242/68 |
| 0973584 | 2/1951 | France | 242/128 |
| 1073719 | 9/1954 | France | 242/129 |
| 2577915 | 8/1966 | France | 242/66 |
| 56-33335 | 4/1981 | Japan | 242/179 |

*Primary Examiner*—Daniel P. Stodola

*Attorney, Agent, or Firm*—Dressler, Goldsmith, Shore & Milnamow, Ltd.

[57] ABSTRACT

A cassette (1') for winding a tape (2') and retaining it as a coil, including a frame surrounding the coil with a central guide member, which radially outwards delimits the inner periphery of the coil and radially inwards delimits an opening in the center of the coil. The frame consists of a framework comprising at least two flat, rigid frame bands symmetrically crossed and interconnected on the back side of the coil. The bands extend radially outwards from their point of intersection, around the outer periphery of the coil and then extend again radially inwards along the front side of the coil, forming finally as the guide members hooked claws, which extend axially across at least a portion of the inner periphery of the coil. This open coil construction is most appropriate for a winding method, in which a winding member is inserted in-between the frame bands and is brought into firm contact with the coil for the tape to be wound onto this.

9 Claims, 4 Drawing Sheets

OPEN CASSETTE FOR WINDING A TAPE THEREIN

This application is a continuation of application Ser. No. 07/302,604, filed Jan. 27, 1989, now abandoned.

BACKGROUND OF THE INVENTION

The invention relates to a cassette intended for winding a tape and for retaining it as a reel, comprising a frame surrounding the coil with a guide member, which delimits the inner periphery of the coil and an opening in the coil centre. The invention also relates to a method for winding and retaining a tape on a cassette of the type above by fixing the cassette and bringing the reel into rotation and winding the tape onto the cassette by means of a rotatory winding member.

In prior known solutions for winding and retaining tapes in cassettes, the winding has been carried out by means of empty reels or reel rims provided with special coupling members, to which the winding members have been connected for the winding. The cassette then comprises small openings equipped with annular guide members delimiting the inner periphery of the reel in order to guide the empty reels or coil rims having coupling members. These solutions for winding tapes onto a cassette are entirely dependent on expensive and special constructions both with regard to the empty reels, reel rims and cassettes. When using a disposable tape in a cassette, there is the additional drawback of having to disassemble the cassette, which has an entirely closed construction, in order to fix the empty reel and the tape to be wound. Consequently, it has been possible to use cassettes only in expensive special packages so far.

FIELD OF THE INVENTION

The purpose of the invention is to provide an improved cassette and an improved winding method of the type described above. The improvement principally aimed at is accessibility of the inner and outer periphery of the reel such that a winding member having a simple construction can be brought into contact with the peripheries and carry out the winding without any special coupling members or empty reels. In other words, the purpose is to provide an extremely simplified cassette and winding method. In this connection, it is essential that the cassette has an open construction for the feeding of the tape to be wound and is easily removable.

SUMMARY OF THE INVENTION

The cassette according to the present invention is characterized by the fact that its frame consists of a framework comprising at least two flat, rigid interconnected frame bands symmetrically crossed on the back side of the reel. These extend on the back side radially outwards from their point of intersection, round the outer periphery of the coil and then extend again radially inwards along the front side of the coil. At their inner ends of the frame bands are hooked claws, which extend axially across at least a portion of the inner periphery of the coil. The method according to the present invention, again, is characterized by the fact that a winding member is inserted in-between the radial frame bands of the type described above and is brought into immediate and firm contact with the reel cylinder for the tape to be wound onto the reel cylinder.

The desired result is thus achieved by giving the cassette the shape of an open framework, which during the winding allows both guiding of the inner periphery of the coil and free inserting of a winding member into immediate contact with the reel cylinder in order to wind the tape.

The reel frame preferably consists of two frame bands, which are perpendicularly crossed and interconnected on the back side of the coil. It is easier to carry out the winding if the inner periphery of the reel consists of a separate reel cylinder. The winding is also easier to carry out, if the edges of the hooked claws are rounded, in order to minimize the friction between these and the inner periphery of the coil.

During the winding, the cassette can be fixed to a winding table by inserting it into an adequately shaped cutting in the table. The claws defining the inner periphery of the coil extend across only a portion of the inner periphery. The winding method can be carried out by inserting a unique, flat, axially symmetrical winding member having an axis and cuttings or similar for the said claws. The winding member fits into the opening in the centre of the coil in-between and passing by the claws which fit into and slide along the cuttings. The winding member is brought to a level below the claws viewed from the opening and into firm contact with the inner periphery of the reel cylinder, upon which the tape is wound onto the cassette by rotation. In this embodiment, the spaces between the bands of the cassette according to the invention are utilized for bringing a central winding member into contact with the inner periphery of the reel cylinder. The winding member is preferably inserted into the centre of the cassette from underneath, through a hole in the winding table.

According to another preferred embodiment of the winding method, the space between the frame bands of the open cassette is utilized so that the winding is carried out by means of a winding member consisting of a plurality of wheels, which are rotatory about axes parallel to and radially displaceable with regard to the winding axis of the cassette. During the winding, the wheels are first radially conducted towards the winding axis in-between the crossed frame bands of the cassette, until they are brought into contact with the outer periphery of the reel cylinder. Subsequently, the wheels and thus the coil are brought into rotation, whereby the tape is wound onto the cassette. During the winding, the wheels are radially displaced outwards as the coil diametre increases. This second embodiment seems far different from the above central winding method, however, in both cases, an open cassette according to the present invention is an absolute prerequisite for carrying out the winding method.

In the latter winding by means of a member consisting of a plurality of wheels, the radial displacement of the wheels is, for instance, guided by longitudinal slots cut into a winding table, in which the axes of the wheels run and are radially guided with regard to the winding centre of the retained cassette. The wheels of the winding member, being preferably four, are driven e.g. by gear wheels connected with these by the axes and disposed underneath the winding table, as well as by a gear belt connected with the gear wheels and a motor. By straining or releasing, this gear belt brings about the said radial displacement. The straining is produced by a supplementary gear wheel also connected with the gear belt and displaceable in the plane of the table by means of a displacing device, e.g. an adjustable pneumatic cylinder. The radial straining of the gear belt is preferably ensured by appropriately disposed guide rolls. In order to produce a continuous contact between the wheels and the coil, the gear wheels are made radially resilient if needed, by means of springs attached to their axes.

BRIEF DESCRIPTION OF THE DRAWINGS

Two exemplified embodiments of the product and methods according to the invention are described in greater detail below with reference to the enclosed drawings.

Figure 1:
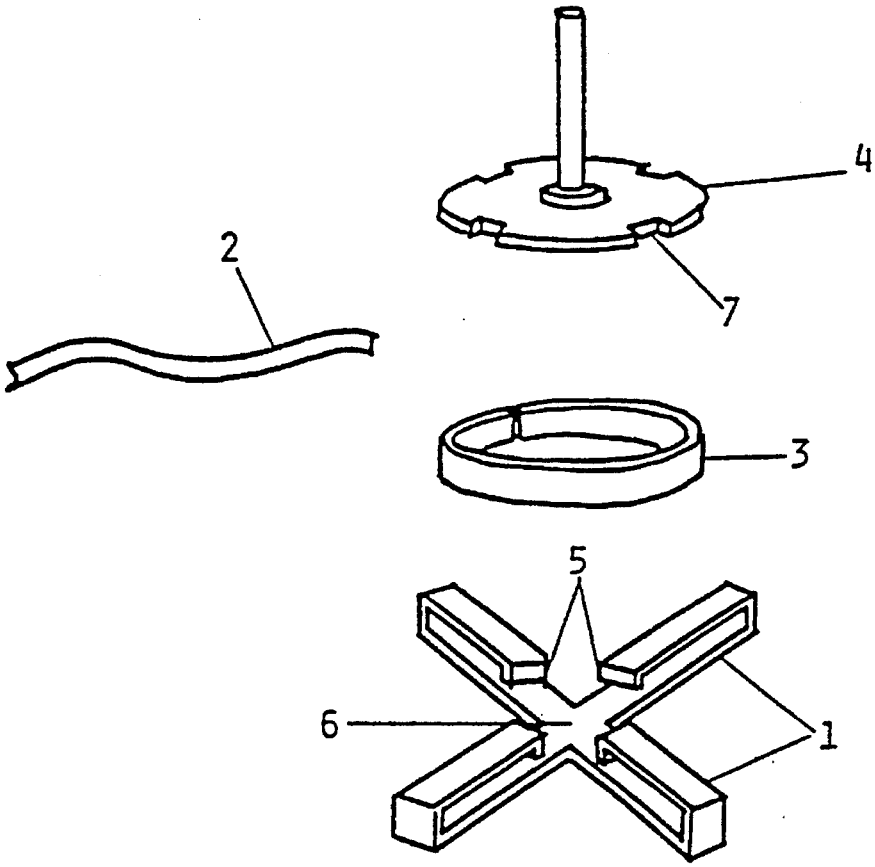
FIG. 1 is an exploded view of an open cassette according to the invention in which the cassette, the reel cylinder, the tape and the winding member are separated.

The system shown in FIG. 1 consists of a cassette according to the invention, a tape 2 to be wound including a reel cylinder 3 and a separate winding member 4 in the form of a disc. The cassette, which is intended for winding a tape and retaining this as a coil, comprises a frame with hooked claws 5, which in the winding position defines the inner periphery of the reel cylinder 3 and defines an opening 6 in the coil centre in view of inserting a disparate winding member 4 into it.

Figure 1A:
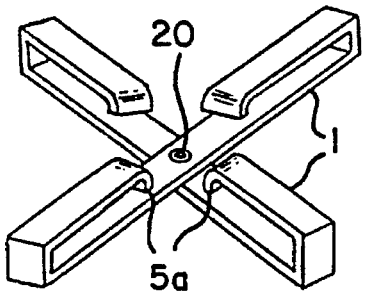
FIG. 1*a* is a perspective view of a modified version of the cassette shown in FIG. 1.

The frame consists of a framework including two flat, rigid frame bands 1 which are symmetrically and perpendicularly crossed and interconnected on the back side of the coil, which on the back side extend radially outwards from their point of intersection, around the outer periphery of the coil and then again radially inwards along the front side of the coil, forming finally as the hooked claws 5, which in the winding position extend axially across a portion of the inner periphery of the reel cylinder 3. The rigid frame bands 1 of this embodiment are preferably flat metal or plastic bands, which are connected by riveting or welding. They are preferably pryable for the removal of the coil. The edges of the claws 5 are preferably rounded in order to minimize the friction between the claws and the rotating coil. In the embodiment shown in FIG. 1*a*, the crossed bands 1 are connected by a rivet 20 and the claws 5*a* are rounded.

When using the winding system of FIG. 1, the cassette is fixed preferably to a winding table (not shown). The reel cylinder 3 is inserted into the cassette centre inbetween the upper and the lower portion of the transverse frame bands 1. This is e.g. carried out by prying the upper portions of the frame bands so that the claws 5 will define the inner periphery of the cylinder 3, this having been inserted.

Subsequently, the winding member 4 is inserted into the reel centre inbetween and passing by the claws 5, these being fitted into and sliding along the cuttings 7. The member 4 is inserted to a level underneath the claws 5 being simultaneously in firm contact with the inner periphery of the reel cylinder 3. The tape 2 is fixed to the groove in the reel cylinder 3. Finally the winding member 4 is brought into rotation with the reel cylinder 3 in order to wind the tape 2 onto the reel cylinder 3. The cassette can be fixed to the winding table by inserting it into a cavity cut in the table for this purpose. The cassette then preferably comprises the opening 6 for inserting the winding member downwards.

Figure 2:
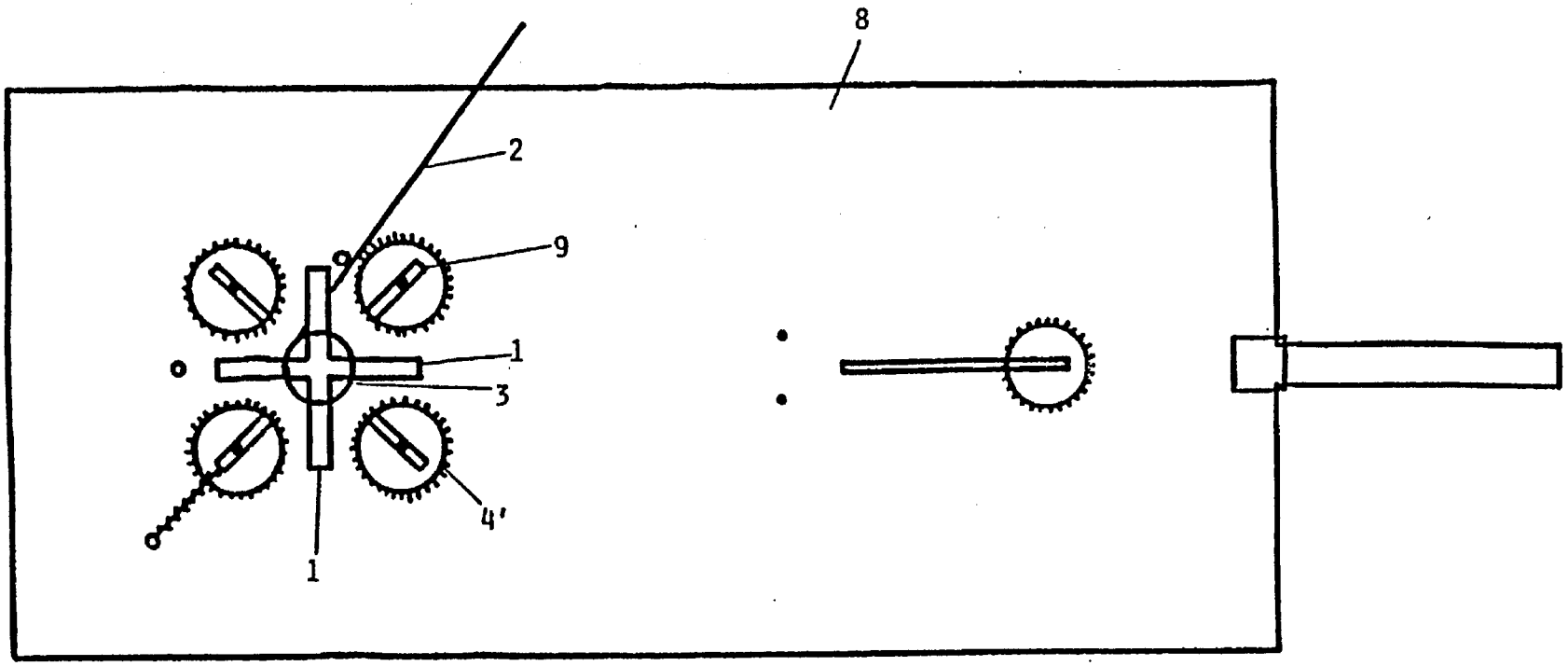
FIG. 2 is a top view of a winding system according to a more preferred embodiment of the invention, in which the cassette, the reel cylinder, the tape, the winding member and the winding table are ready for operation.

The winding system shown in FIG. 2 consists of the open cassette 1, a cylinder 3 inserted into this, whereby the claws 5 of the cassette (not shown) define the inner periphery of the cylinder 3, a tape 2 slipped onto the cylinder and a winding member consisting of four wheels 4'. The cassette is inserted into an adequately shaped cutting in the winding table 8. The wheels 4' are rotatable about axes parallel to and radially displaceable with regard to the winding axis of the cassette. The radial displacement of the wheels 4' is guided by longitudinal slots 9 cut into the winding table 8, in which the axes of the wheels 4' run and are radially guided with regard to the winding core of the cassette.

According to this embodiment, the winding starts by inserting the wheels 4' radially towards the winding axis inbetween the crossed frame bands 1 of the cassette until the wheels are brought into contact with the outer periphery of the reel, in this case the reel cylinder 3. By bringing the wheels 4' into rotation at essentially the same rate the cylinder 3 is also brought into rotation, thus winding the tape onto the cylinder 3. During the winding, the wheels are displaced, either by programming or by an elastic device, radially outwards as the coil diametre increases.

FIG. 3 is a view from underneath and a lateral view of the driving, straining and spring mechanism by means of which the winding of FIG. 2 is carried out. The wheels 4' of the winding member are driven by gear wheels 10 connected to these by axes and disposed underneath the winding table as well as by a gear belt 12 connected to the gear wheels 10 and a motor 11. The radial displacement of the wheel axes is produced by straining or releasing the gear belt. This is done by connecting the gear belt 12 to a supplementary gear wheel 14 which is displaceable in the table plane by means of an adjustable pneumatic cylinder 13.

The radial straining of the gear belt 12 is ensured by appropriately disposed guide rolls 15. The gear wheels are preferably made resilient by means of springs 16 attached to their axes.

Figure 3B:
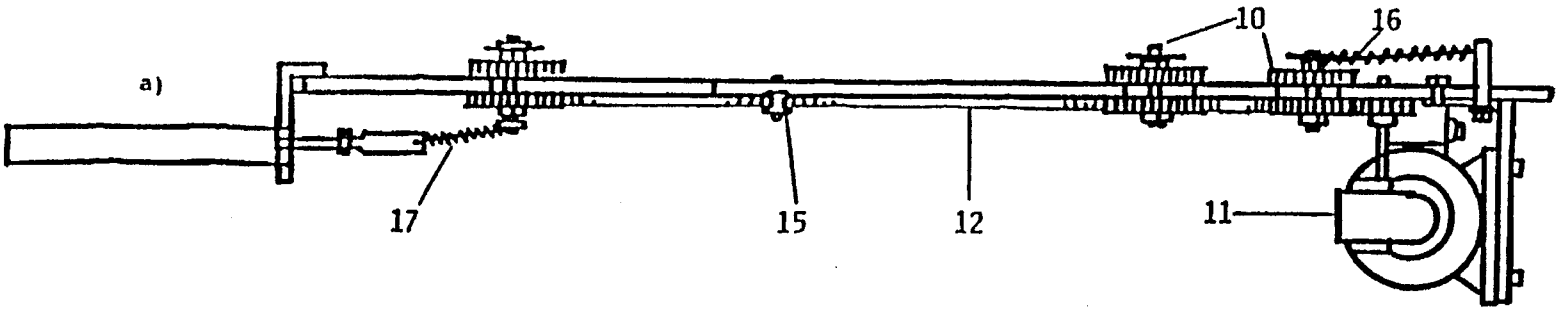
FIG. 3*b* is a lateral view of the same system.
Figure 3A:
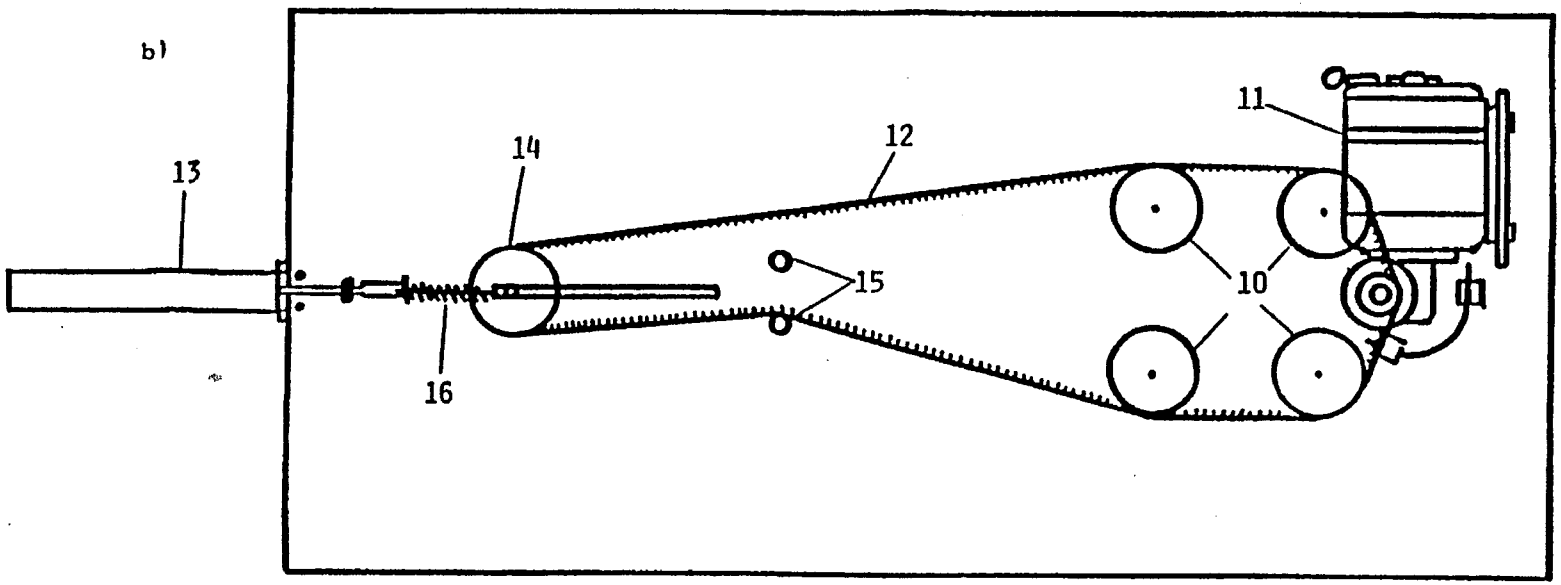
FIG. 3*a* is a bottom view of a winding system according to FIG. 2.
Figure 4:
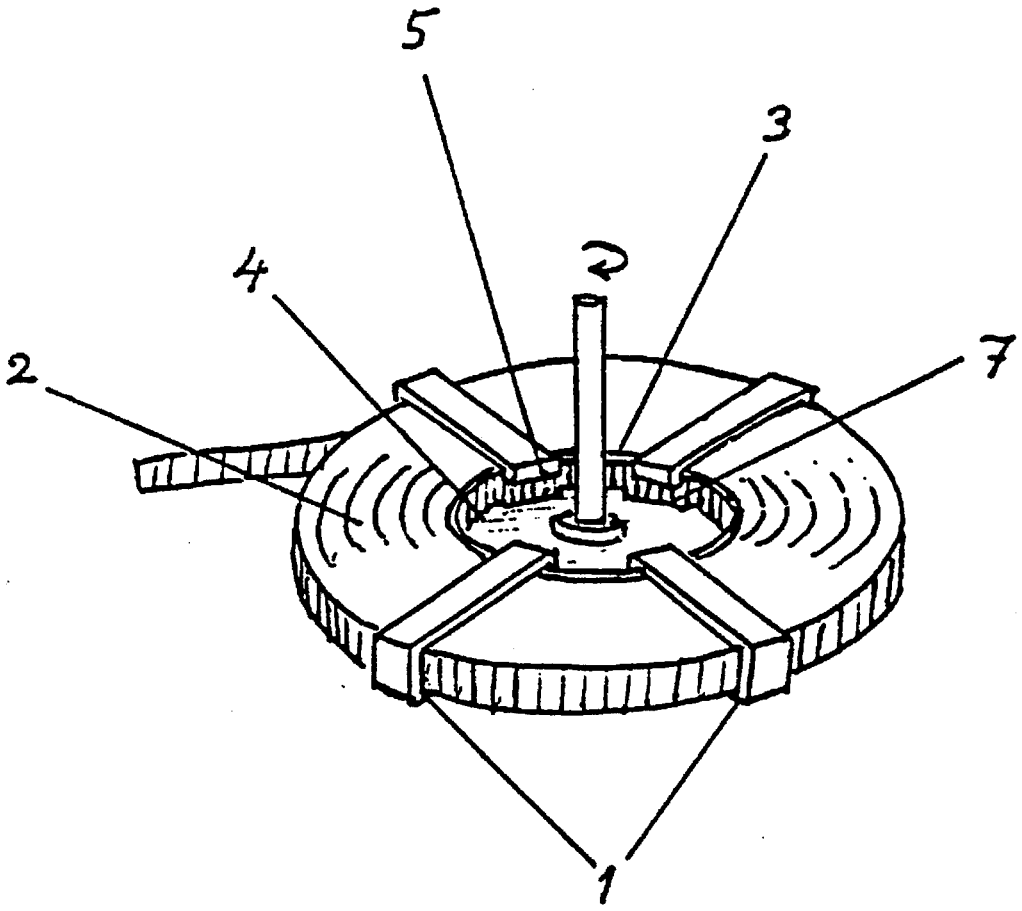
FIG. 4 is a perspective view of a cassette showing a full tape located therein.

During the winding, an empty cassette is first placed in the cut grooves and the cylinder is inserted into the cassette. The wheels 4' of the winding member are now pressed against the cylinder 3 by straining the gear belt 12 with the aid of the gear wheel 14, which is reversed by a pneumatic cylinder 13. The straining of the gear and winding wheels disposed on the same axis is made resilient by springs, which in FIG. 3*a* and 3*b* are disposed between the supplementary gear wheel 14 and the pneumatic cylinder 13 and between one of the wheels 4' and a pin fixed to the winding table 8. In this manner, the wheels 4' are pressed radially and resiliently against the reel cylinder 3.

After this the motor is started and the tape starts winding into the cassette. The winding wheels 4', which are preferably rubber cogged, guide the tape end 2 around the cylinder 3. As the roll increases, the pressure in the pneumatic air cylinder 13 decreases, either manually or automatically. During the winding, the wheels 4' move radially outwards from the winding core as the roll increases. When the reel is full, the pressure is released from the air cylinder 13, thus releasing the winding wheels 4', and the full cassette is removable and a new empty cassette can be inserted.

I claim:

1. A cassette in which a tape is adapted to be wound into a coil having an inner and outer periphery, which cassette comprises a frame, the frame consisting of a framework including at least two flat, rigid frame bands symmetrically crossed and interconnected which defines the backside of the cassette, said bands extend radially outward from their point of intersection, across the outer periphery of the coil and then extend again radially inward toward the center of the coil and define at their inner ends rigid hooked claws that extend axially toward the backside of the cassette to form guide members which define the inner periphery of the coil.

2. A cassette according to claim 1, characterized in that there are only two frame bands and in that they are perpendicularly crossed on the back side of the cassette.

3. A cassette according to claim 2, characterized in that the rigid frame bands (1) are flat metal bands, connected by riveting and pryable for removal of the coil cylinder.

4. A cassette according to claim 1, characterized in that the edges of the claws are rounded in order to minimize the friction between them and the inner periphery of the coil cylinder.

5. Apparatus for winding a tape into a coil about a framework, said framework consisting of an open framework including at least two flat, rigid frame bands symmetrically crossed and interconnected, which define a backside of a cassette, said bands extend radially outward from their point of intersection, across the outer periphery of the coil to be formed and then radially inward toward the center of the coil to be formed, said bands define at their inner ends rigid claws that extend axially toward the backside of the cassette to form guide members which define the inner periphery of the coil, a rotating mechanism disposed between the longitudinal sides of the frame band and into contact with the tape for rotating said tape to form a coil.

6. Apparatus for winding a tape into a coil having an inner and outer periphery comprising a reel cylinder for receiving a tape, a frame surrounding said reel cylinder, said frame consisting of an open framework including at least two flat rigid frame bands symmetrically crossed and interconnected which defines the backside of a cassette, said bands extend radially outward from their point of intersection, across the outer periphery of the coil, and then extends radially inward toward the center of the coil and define at their inner ends rigid claws that extend axially toward the backside of the cassette within the reel cylinder to position said reel cylinder, and means for rotating the reel cylinder to form a coil.

7. Apparatus as set forth in claim 6 wherein the means for rotating the reel cylinder consists of a disc member defined to extend within the framework along longitudinal sides of the bands into contact with the reel cylinder for rotation thereof.

8. Apparatus as set forth in claim 6 in which the means for rotating the reel cylinder for wrapping the tape consists of a plurality of wheels that engage the reel cylinder to rotate the reel cylinder to wrap the tape, and gear means for driving said wheels.

9. Apparatus as set forth in claim 8 in which the wheels are resiliently mounted, whereby winding of the tapes permits outward displacement of the wheels.

* * * * *